US005161265A

United States Patent [19]

Mikiya et al.

[11] Patent Number: 5,161,265

[45] Date of Patent: Nov. 10, 1992

[54] NOZZLE WITH SUCKER

[75] Inventors: Toshio Mikiya; Kuniaki Shibuya, both of Tokyo, Japan

[73] Assignee: Nikki Co., Ltd., Tokyo, Japan

[21] Appl. No.: 762,253

[22] Filed: Sep. 19, 1991

Related U.S. Application Data

[63] Continuation of Ser. No. 682,890, Apr. 8, 1991, abandoned, which is a continuation of Ser. No. 392,407, Aug. 11, 1989, abandoned.

[30] Foreign Application Priority Data

Aug. 23, 1988 [JP] Japan ..... 63-110426[U]

[51] Int. Cl.[5] ..... A61H 33/02

[52] U.S. Cl. ..... 4/541.3; 4/541.4; 4/568; 239/448; 248/206.3

[58] Field of Search ..... 4/492, 494, 496, 541, 4/542, 544, 567, 568, 601, 605, 615; 248/205.5, 205.6, 205.7, 206.1, 206.2, 206.3, 206.4, 363; 239/99, 101, 282, 283, 443, 445, 446, 448, 587

[56] References Cited

U.S. PATENT DOCUMENTS

| | | | |
|---|---|---|---|
| 1,985,502 | 12/1934 | Isenberg | 248/205.5 X |
| 2,072,345 | 3/1937 | Schneider | 248/205.5 X |
| 2,095,170 | 10/1937 | Conklin | 248/205.5 X |
| 2,312,220 | 2/1943 | Snyder | 248/206.1 X |
| 2,799,866 | 7/1957 | Jawett | 4/542 |
| 2,893,644 | 7/1959 | Holden | 248/205.5 X |
| 3,286,712 | 11/1966 | Roden | 4/544 X |
| 3,406,680 | 10/1968 | Roden | 4/544 X |
| 3,638,889 | 2/1972 | Samuelson | 248/206.3 |
| 4,506,855 | 3/1985 | McElhaney | 248/206.2 |
| 4,629,124 | 12/1986 | Gruber | 239/448 X |
| 4,666,114 | 5/1987 | Kroczynski et al. | 248/205.6 |
| 4,933,999 | 6/1990 | Mikiya et al. | 4/568 |

FOREIGN PATENT DOCUMENTS

| | | | |
|---|---|---|---|
| 2872977 | 1/1979 | Fed. Rep. of Germany | 4/542 |
| 43-21212 | 9/1968 | Japan . | |
| 63-114640 | 7/1985 | Japan . | |

*Primary Examiner*—Henry J. Recla
*Assistant Examiner*—Robert M. Fetsuga
*Attorney, Agent, or Firm*—Nixon & Vanderhye

[57] ABSTRACT

A nozzle with sucker comprises a nozzle body having a jet hole for hot water, a sucker attached to a rear face portion of the nozzle body and adapted to fix the nozzle body to the surface of a wall of a bathtub by suction, and an angle adjusting member for adjusting the angle of the nozzle body compared to the surface of hot water in the bathtub. Thus, the nozzle can be easily attached to and detached from the wall surface of the bathtub.

5 Claims, 15 Drawing Sheets

NOZZLE WITH SUCKER

This is a continuation of application Ser. No. 07/682,890, filed Apr. 8, 1991, now abandoned which is a continuation of application Ser. No. 07/392,407, filed Aug. 11, 1989, now abandoned.

BACKGROUND OF THE INVENTION

1. Field of the Invention

The present invention relates to a nozzle with sucker for bath-jet massage.

2. Description of the Related Art

Some of conventional bath-jet massaging apparatuses are adapted to be fixed in a bathtub, and the others are composed of a jet hole in the inner wall surface of a bathtub, from which a flow of a mixture of hot water and air is ejected.

According to these conventional apparatuses, however, the jets are ejected only from a fixed position on the wall surface of the bathtub, so that all parts of a user's body cannot be massaged.

SUMMARY OF THE INVENTION

The object of the present invention is to provide a nozzle with sucker means capable of being removably attached to any desired region of the inner wall surface of a bathtub, and usable in hand if necessary.

The above object of the invention is achieved by a nozzle with sucker constructed as follows. The nozzle comprises a nozzle body having a jet hole for hot water, sucker means attached to a rear face portion of the nozzle body and adapted to fix the nozzle body to the surface of a wall of a bathtub by suction, and angle adjusting means for adjusting the angle of the nozzle body compared to the surface of hot water in the bathtub.

Thus, in the nozzle with sucker means according to the present invention, a flow of a mixture of hot water and air can be ejected from the hot-water jet hole, with the nozzle fixed to the inner wall surface of the bathtub by means of the sucker means, or with the nozzle held in hand without being fixed in the bathtub, so that the jet hole is directed to a desired part of a user's body.

If the inner wall surface of the bathtub is a slant surface, the nozzle body may be held parallel to the hot water surface or suitably positioned relatively to the user's body.

Holding the nozzle in hand, the user can get a jet massage on any desired parts of his or her body.

Thus, according to the present invention, the sucker means are attached to the nozzle. In this arrangement, the position of the nozzle can be shifted to any desired position on the inner wall surface of a bathtub by means of the sucker means. Therefore, the jet massage can be effected at any suitable position in the bathtub, so that the user can enjoy the massage on any desired parts of his or her body.

According to the present invention, furthermore, a sucking surface of the nozzle can be tilted with respect to a nozzle ejecting surface. Even if the inner wall surface of the bathtub is a slant surface, therefore, the jet can be ejected parallel or at a certain angle to the hot water surface. Thus, the massage can be effected in any desired directions.

DETAILED DESCRIPTION OF THE PREFERRED EMBODIMENTS

Figure 1:
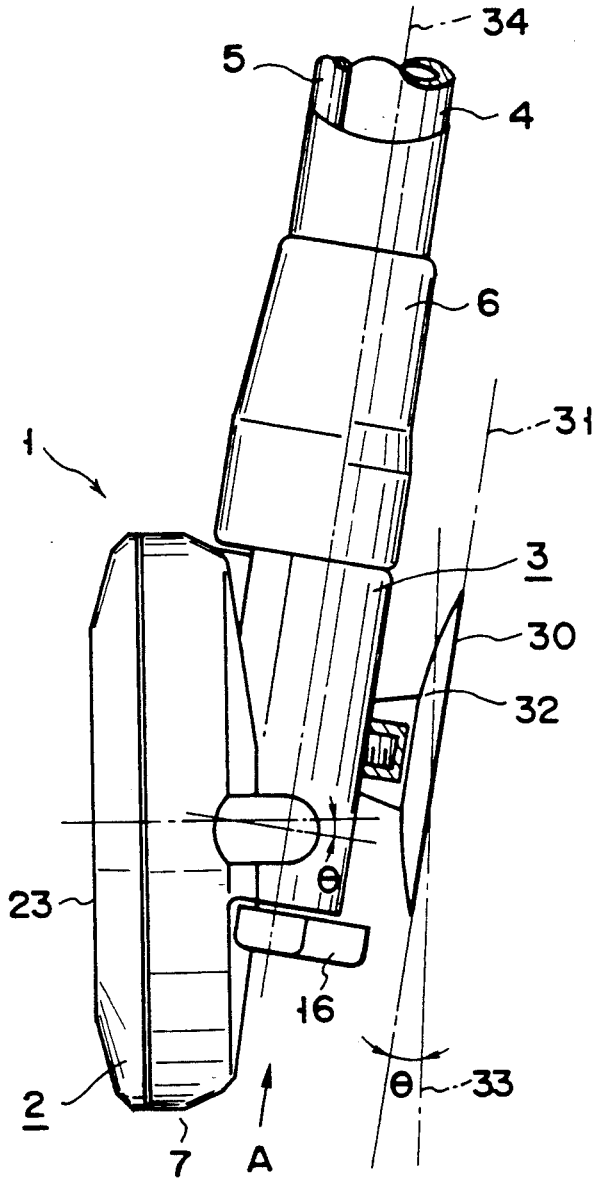
FIG. 1 is a side view of a nozzle according a first embodiment of the present invention.

Various embodiments of the present invention will now be described in detail with reference to the accompanying drawings. In the description of the individual embodiments to follow, like reference numerals are used to designate like portions, and repeated explanation of those portions is omitted for the second and subsequent embodiments.

Figure 2:
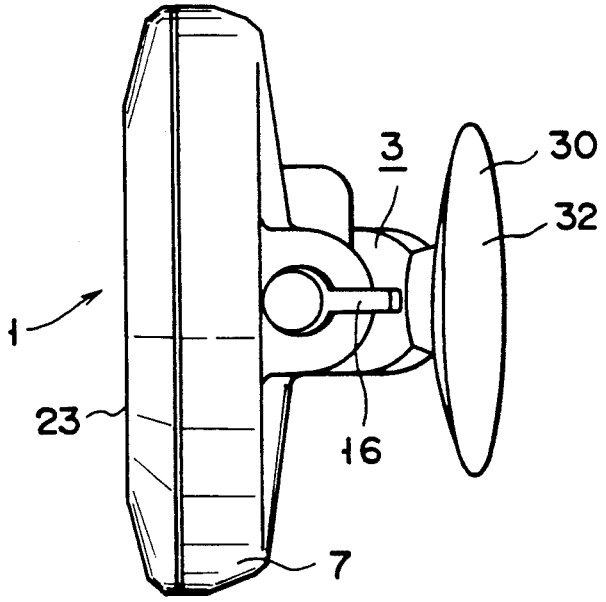
FIG. 2 is a perspective view taken in the direction of arrow A.

FIGS. 1 and 2 show a nozzle with sucker according to a first embodiment of the present invention.

In FIGS. 1 and 2, nozzle 1 comprises ejecting portion 2 and hot-water supply barrel 3. Arranged in barrel 3 are hot-water duct 4, which communicates with a discharge port of a pump (not shown), and air duct 5 through which air from a bathroom is introduced into nozzle 1. Grip 6 is formed at the proximal end portion of barrel 3, while ejecting portion 2 is fixedly connected to the distal end portion of barrel 3.

Figure 3:
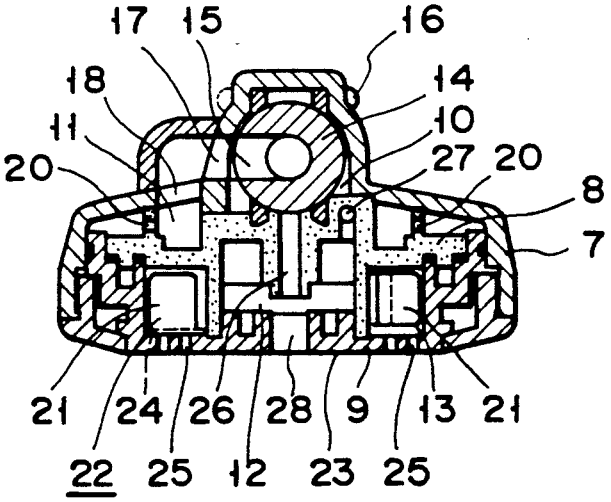
FIG. 3 is a vertical sectional view of the nozzle.

FIG. 3 shows the internal construction of ejecting portion 2. In FIG. 3, the inside of nozzle case 7 is divided by partition walls 8 and 9 so that valve chamber 10, hot-water passage chamber 11, gas-liquid mixing chamber 12, and impeller chamber 13 are defined in case 7. Spherical valve 14 is housed in valve chamber 10, and L-shaped flow-changing passage 15 is formed inside valve 14. The inlet of passage 15 communicates with hot-water duct 4. Valve 14 is provided with lever 16 for changing the course of flow. In the position of lever 16 shown in FIG. 3, the outlet of passage 15 communicates with valve hole 17, so that hot water fed through duct 4 gets into hot-water passage chamber 11 via hole 17 and through hole 18, whereupon it flows through passage 20 and another passage (not shown) to be ejected into impeller chamber 13. Impeller 22 is rotatably housed in chamber 13. It has a plurality of vanes 21, three vanes in FIG. 3, arranged circumferentially at regular intervals. Impeller 22 rotates when a jet of the hot water runs against vanes 21 of the impeller. Shutter plate 24 is attached to the end of each of two of vanes 21. When impeller 22 rotates, plates 24 successively close shower holes 25, so that intermittent shower jets are delivered from holes 25.

When lever 16 is rotated through 90° in the counterclockwise direction from the state of FIG. 3, the outlet of flow-changing passage 15 communicates with central passage 26, and valve hole 17 is closed by valve 14. As a result, the hot water flows into gas-liquid mixing chamber 12 through passage 26. Meanwhile, air inlet hole 27, which communicates with air duct 5, opens into chamber 12. The air introduced through duct 5 from the bathroom is sucked into mixing chamber 12 by an ejector effect of the hot water, and the hot water and the air are mixed in chamber 12. The resulting mixture flow is ejected as a jet from jet hole 28.

In the first embodiment described above, sucker 32 is fixed to that part of the distal end portion of hot-water supply barrel 3 near the rear face of ejecting portion 2, by means of an universal joint, a screw or the like. Sucker 32 is allowed to move the head up and down, or right and left directions with respect to barrel 3. Sucking surface 30 of sucker 32 is adapted to be attached to inner wall surface 31 of a bathtub. If surface 31 is a slant surface, barrel 3 ought to be slightly rocked downward to be substantially perpendicular to the surface of the hot water, in order that the jet can be ejected substantially parallel to the hot water surface.

In enjoying a massage by means of the jet, nozzle 1 is normally immersed in the hot water in the bathtub. When the intermittent shower jets are used for the massage, nozzle 1 is kept above the hot water surface.

Figure 4:
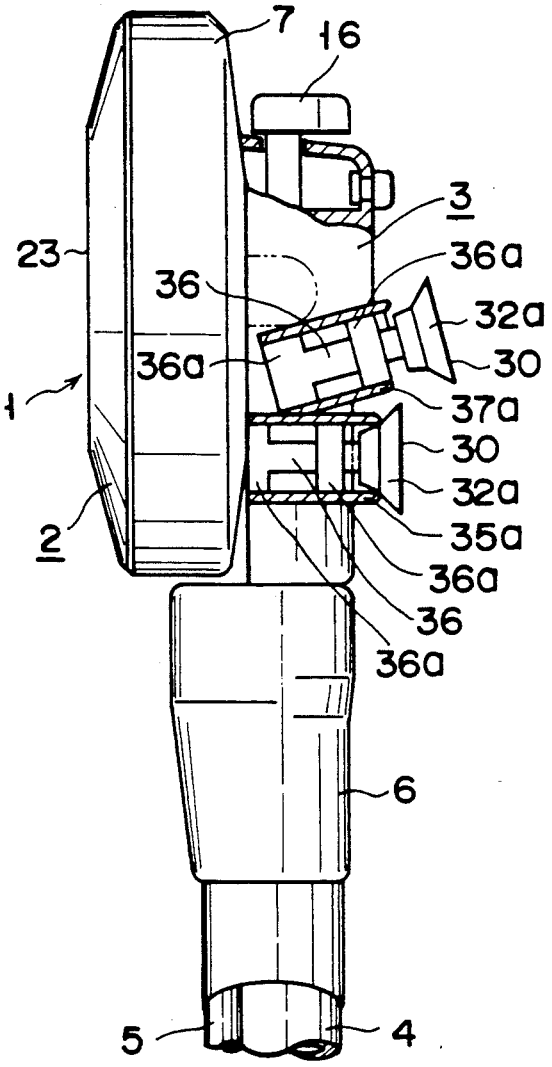
FIG. 4 is a side view of a nozzle according to a second embodiment of the invention.
Figure 5:
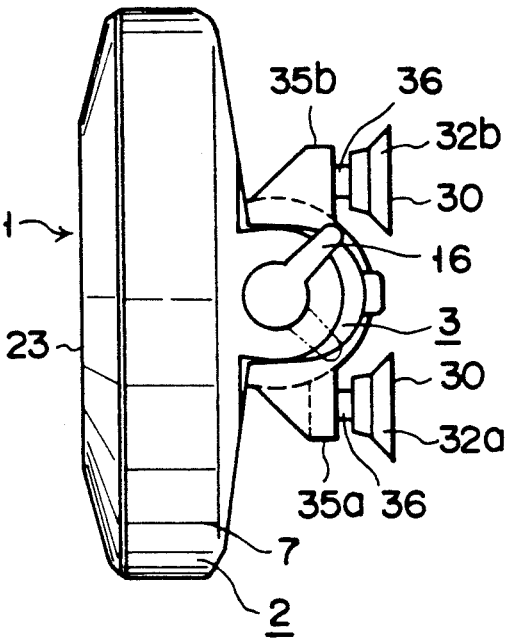
FIG. 5 is a plan view of the nozzle shown in FIG. 4.

FIGS. 4 and 5 show a second embodiment of the present invention.

In this embodiment, hot-water supply barrel 3 is formed parallel to nozzle ejecting surface 23, and a pair of suckers 32*a* and 32*b* are attached to a rear face portion of nozzle case 7, on either side of barrel 3. More specifically, a pair of L-shaped first cylinders 35*a* and 35*b* protrude from the rear face portion of case 7, on either side of barrel 3, and suckers 32*a* and 32*b* are fixed to the respective distal end portions of their corresponding piston shafts 36 by means of screws or the like. Each shaft 36 includes piston portion 36*a* formed of an elastic material, such as rubber. Shafts 36 are fitted in their corresponding first cylinders 35*a* and 35*b*, and are prevented from slipping out by the elastic frictional force of their respective piston portions 36*a*. In the second embodiment, moreover, second cylinders 37*a* and 37*b* (37*b* is not shown) protrude from the rear face portion of nozzle case 7 so as to be arranged beside first cylinders 35*a* and 35*b* at an angle to the respective central axes thereof. Each piston shaft 36 can be removably attached to both of its corresponding first and second cylinders. If nozzle 1 is fixed to vertical inner wall surface 31 of the bathtub by means of suckers 32*a* and 32*b*, the jet is ejected horizontally. If wall surface 31 is a slant surface, piston shafts 36 are fitted individually in second cylinders 37*a* and 37*b*. In this state, if nozzle 1 is fixed to slant surface 31 of the bathtub by means of suckers 32*a* and 32*b*, jet hole 28 is directed horizontally, so that the jet is also ejected horizontally into the bathtub.

By thus selecting the cylinders to be fitted with piston shafts 36 according to the tilt of inner wall surface 31 of the bathtub, the jet can be ejected horizontally without regard to the tilt of surface 31. In this second embodiment, piston portions 36*a* of piston shafts 36 are fitted tight in cylinders 35*a*, 35*b*, 37*a* and 37*b*. If shafts 36 are drawn out to any desired position, therefore, they can be frictionally fixed at that position. Thus, nozzle 1 can be adjusted in height relative to inner wall surface 31.

Figure 6:
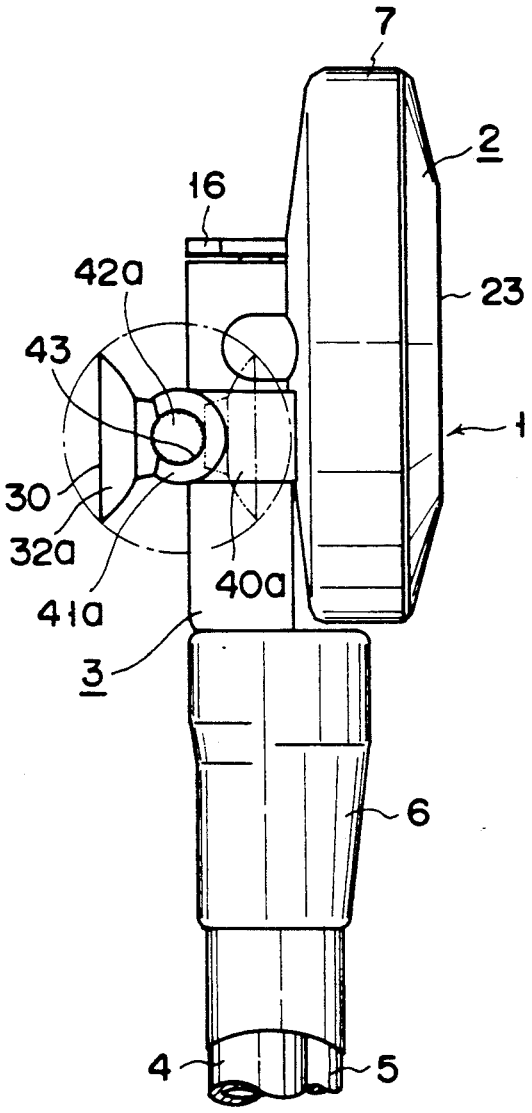
FIG. 6 is a side view of a nozzle according a third embodiment of the invention.
Figure 7:
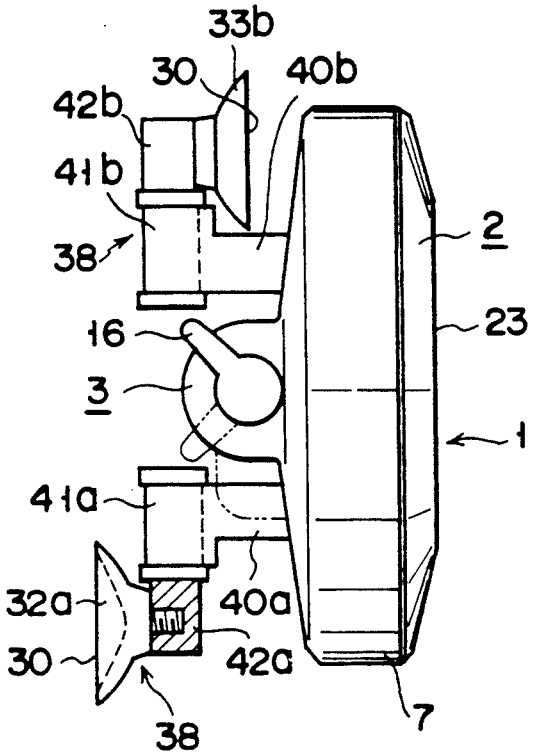
FIG. 7 is a plan view of the nozzle shown in FIG. 6.

FIGS. 6 and 7 show a third embodiment of the present invention.

In this embodiment, rocking retaining means 38, which doubles as holding means for suckers 32*a* and 32*b*, is formed between the rear face portion of nozzle case 7 and the suckers. More specifically, a pair of arms 40*a* and 40*b* protrude from the rear face portion of case 7, at right angles to nozzle ejecting surface 23, on either side of hot-water supply barrel 3, and bearing cylinder portions 41*a* and 41*b* are formed at the distal end portions of arms 40*a* and 40*b*, respectively, so as to extend parallel to surface 23. Shafts 42*a* and 42*b* are rockably fitted in an unremovable manner in cylinder portions 41*a* and 41*b*, respectively. Suckers 32*a* and 32*b* are fixed to the projecting end portions of shafts 42*a* and 42*b*, respectively, so as to be directed at right angles to the axes of the shafts, by means of screws. Those surfaces of shafts 42*a* and 42*b* in engagement with bearing cylinder portions 41*a* and 41*b* are formed of an elastic material, such as rubber or plastics. Knurls 43 for higher friction are formed on the elastic surfaces. If necessary, the respective inner peripheral surfaces of cylinder portions 41*a* and 41*b* in contact with knurls 43 may be also knurled.

In this third embodiment, sucking surfaces 30 of suckers 32*a* and 32*b* can be turned in any suitable direction around shafts 42*a* and 42*b* by rocking these shafts in a desired direction against frictional force produced by knurls 43. If inner wall surface 31 of the bathtub is a slant surface, therefore, the jet can be ejected horizontally by rocking suckers 32*a* and 32*b* to a position to compensate the tilt of surface 31 so that sucking surfaces 30 can be attached directly opposite to slant surface 31. In enjoying a massage with nozzle 1 in hand, suckers 32*a* and 32*b* can be retracted so that their sucking surfaces 30 face the rear face of nozzle case 7, as indicated by two-dot chain line of FIG. 6 and the illustration of sucker 32*b* of FIG. 7. By doing this, the jet massage can be enjoyed without being hindered by the suckers. Since suckers 32*a* and 32*b* can be retracted in this manner, moreover, the aesthetic feeling of the bathtub cannot be spoiled by nozzle 1.

In the third embodiment, furthermore, suckers 32*a* and 32*b* are fixed to their corresponding independent shafts 42*a* and 42*b*. Alternatively, however, arms 40*a* and 40*b* may be made a little longer so that a shaft is stretched between and fitted in bearing cylinder portions 41*a* and 41*b*, and suckers 32*a* and 32*b* may be attached individually to the two opposite ends of the shaft.

Figure 8:
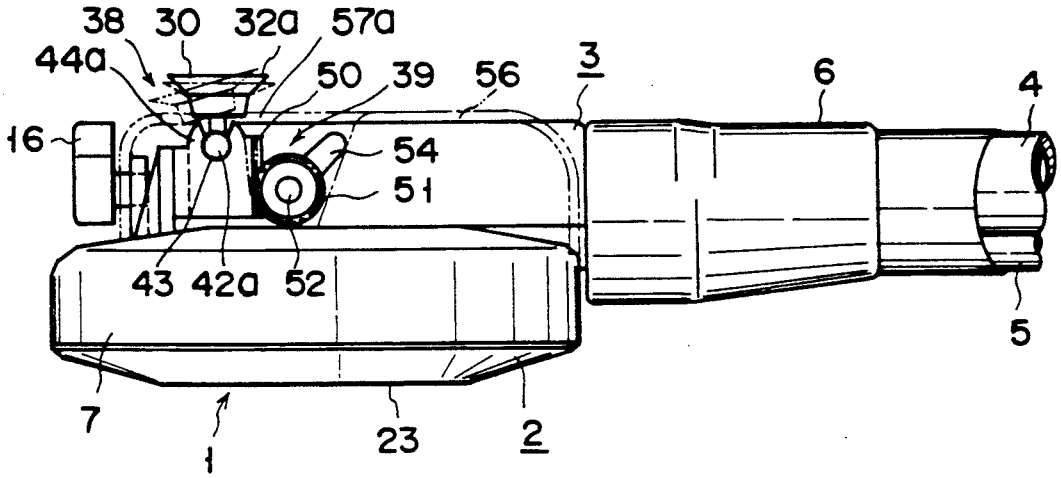
FIG. 8 is a side view of a nozzle according a fourth embodiment of the invention.
Figure 9:
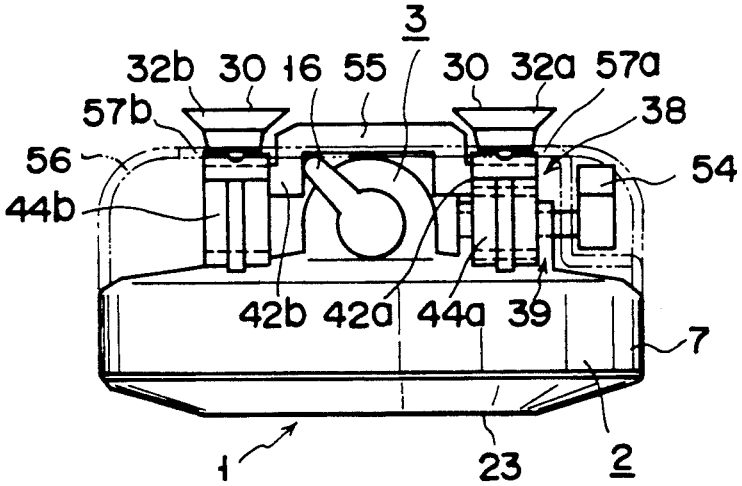
FIG. 9 is a left side view of the nozzle shown in FIG. 8.
Figure 10:
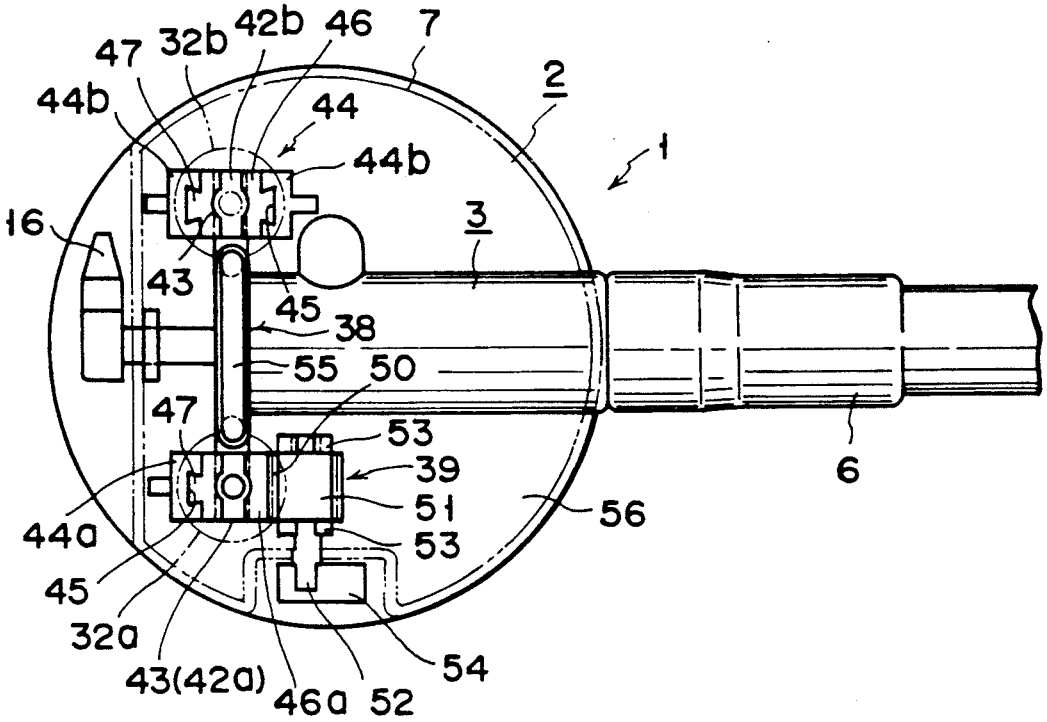
FIG. 10 is a plan view of the nozzle shown in FIG. 8.

FIGS. 8 to 10 show a fourth embodiment of the present invention.

In this embodiment, rocking retaining means 38 is provided so that suckers 32*a* and 32*b* are rockable and can be held in any desired rocking positions, and holding means 39 is provided so that the suckers can be housed in nozzle case 7 by vertical motion. More specifically, slide guides 44*a* and 44*b* protrude from the rear face portion of case 7, at positions symmetrical with respect to hot-water supply barrel 3. Guide 44*b* is formed of guide plates having dovetail grooves 45 opposed to each other, and slider 46 is slidably fitted in guide 44*b*. Slider 46 is formed with projections 47 having taper surfaces which mate with grooves 45. The position of slider 46 is regulated as projection 47 engage grooves 45. On the other hand, slide guide 44*a* is formed of an erect guide plate having dovetail groove 45. Slider 46*a* having projection 47 is fitted in groove 45 of guide 44*a*. Rack 50 is formed on that surface of slider 46*a* opposite to groove 45. Pinion 51 is in mesh with rack 50. Rotating shaft 52 of pinion 51 is supported by means of two bearing plates 53 which protrude from the rear face of nozzle case 7. Control lever 54 is fixedly fitted on the extreme end of shaft 52. As in the third embodiment, shafts 42*a* and 42*b* having knurls 43 on their respective surfaces are fitted in sliders 46*a* and 46*b*, respectively, and suckers 32*a* and 32*b* are fixed to shafts 42*a* and 42*b*, respectively, by means of screws or the like. Thus, suckers 32*a* and 32*b* can be held in any desired rocking positions by being rocked around shafts 42*a* and 42*b* against frictional force produced by knurls 43. Those mating parts between shafts 42*a* and 42*b* and sliders 46*a* and 46*b* constitute rocking retaining means 38 for suckers 32*a* and 32*b*.

Slide guides 44*a* and 44*b* are coupled by means of arm 55. Thus, pinion 51 is rotated by turning control lever 54 in a desired direction, so that rack 50, which is in mesh with pinion 51, moves vertically, that is, sucker 32*b* moves vertically. The vertical motion of sucker 32*b* is transmitted through arm 55 to slide guide 44*b*, so that suckers 32*a* and 32*b* are moved in association with each other. The mechanism composed of rack 50 and pinion 51 for the vertical motion constitutes holding means 39 for suckers 32*a* and 32*b*.

In fixing nozzle 1 to inner wall surface 31 of the bathtub, in this fourth embodiment, control lever 54 is turned to force out suckers 32*a* and 32*b* from through holes 57*a* and 57*b*, respectively. In this state, suckers 32*a* and 32*b* can be attached to surface 31. If wall surface 31 is inclined at an angle to a vertical plane, the suckers are tilted corresponding to the tilt of surface 31 when they are attached to surface 31. By doing this, the jet can be ejected horizontally into the bathtub. In enjoying a massage with nozzle 1 in hand, suckers 32*a* and 32*b* can be drawn back to the inside of cover 56 through holes 57*a* and 57*b* by turning control lever 54 in the opposite direction. By doing this, the jet massage can be enjoyed without being hindered by the suckers.

Figure 11:
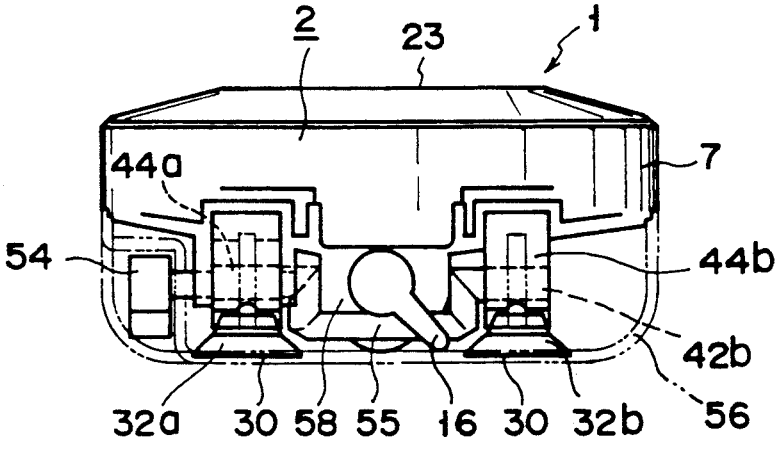
FIG. 11 is a side view of a nozzle according a fifth embodiment of the invention.

FIG. 11 shows a fifth embodiment of the present invention.

This embodiment has substantially the same arrangement as the fourth embodiment, and differs from the latter only in that recess 58 is formed at that portion of nozzle case 7 in which arm 55 moves, and that slide guides 44*a* and 44*b* are coupled to each other by means of arm 55 in recess 58. By thus housing arm 55 in recess 58, the height of arm 55 above case 7 can be reduced. In projecting or retracting suckers 32*a* and 32*b* through holes 54*a* and 57*b* of cover 56, moreover, arm 55 can be vertically moved inside the cover, so that nozzle 1 can be made thinner.

FIGS. 12 to 15 show a sixth embodiment of the present invention.

In this embodiment, the mechanism for the vertical motion of suckers 32*a* and 32*b* of the fourth and fifth embodiments, including rack 50 and pinion 51, is omitted. One shaft 42 is passed through the respective bearing portions of retaining arms 60*a* and 60*b* which protrude from the rear face of nozzle case 7. Lever 61 is fixedly attached to one end of shaft 42. Also, suckers 32*a* and 32*b* are fixed to shaft 42 by means of screws or the like. Thus, by turning lever 61, suckers 32*a* and 32*b* can be rotated around shaft 42 to tilt their respective sucking surfaces. In this case, if knurls 43 are formed at those portions of shaft 42 which engage the bearing portions of arms 60*a* and 60*b*, the suckers can be held at any desired rotational angular position.

In this sixth embodiment, moreover, opening 62 is formed at the front part of cover 56 where suckers 32*a* and 32*b* are arranged. Opening 62 can be closed by means of sliding cover 63.

Figure 12:
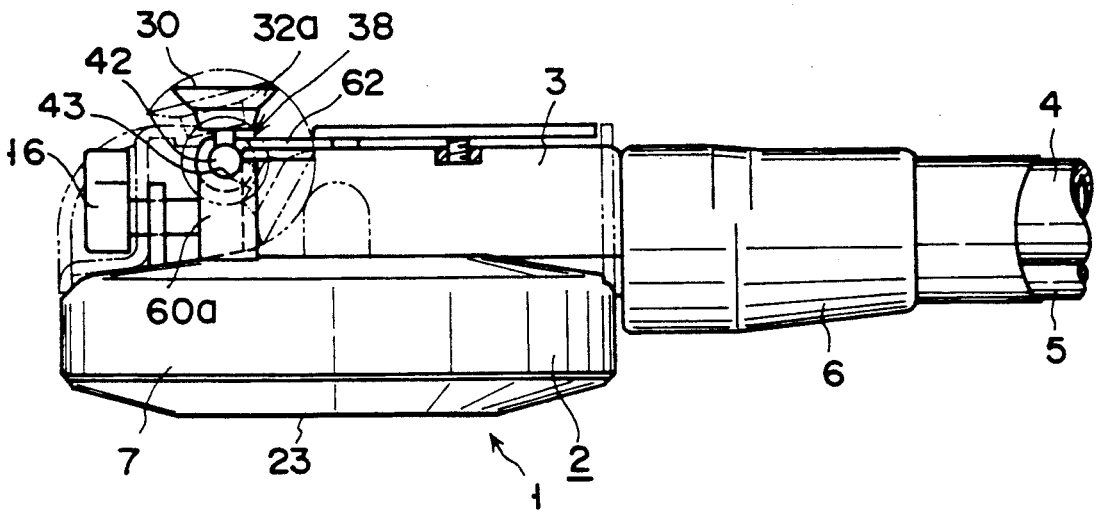
FIG. 12 is a side view of a nozzle according a sixth embodiment of the invention.
Figure 13:
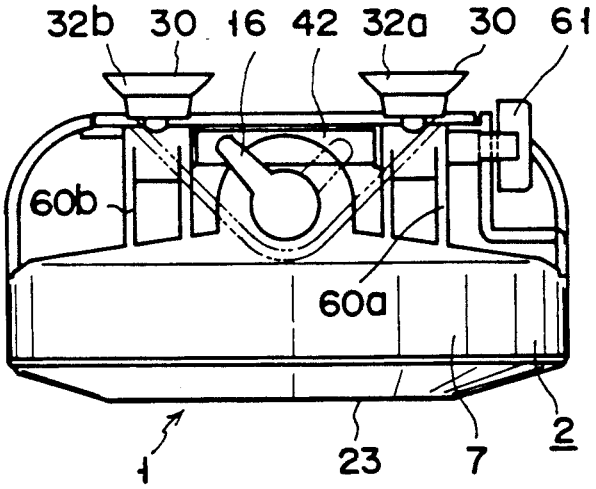
FIG. 13 is a left side view of the nozzle shown in FIG. 12.
Figure 14:
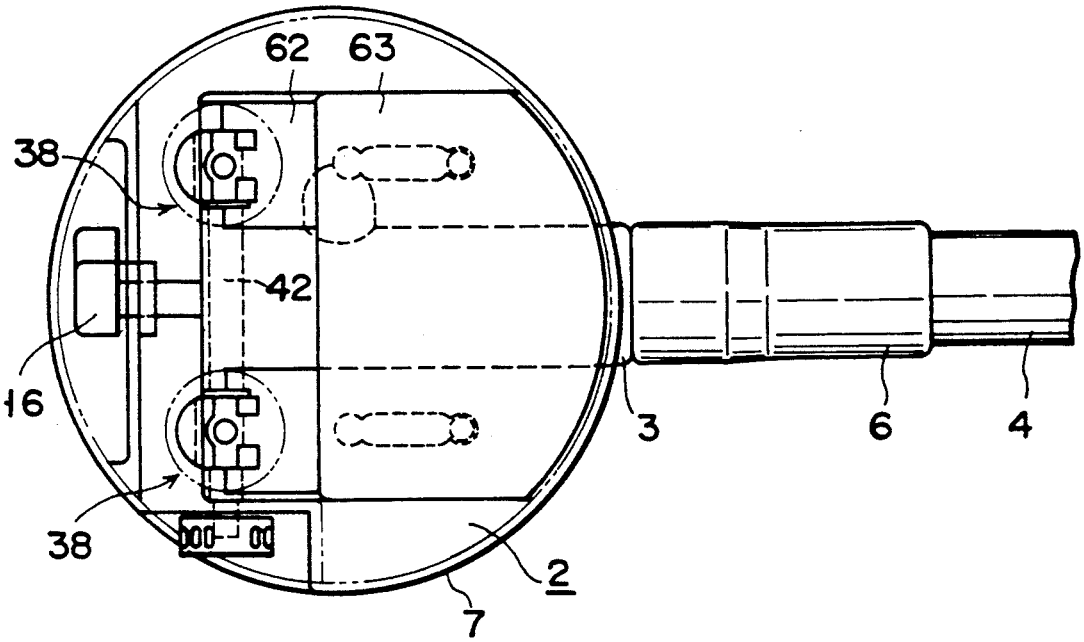
FIG. 14 is a plan view of the nozzle shown in FIG. 12.
Figure 15:
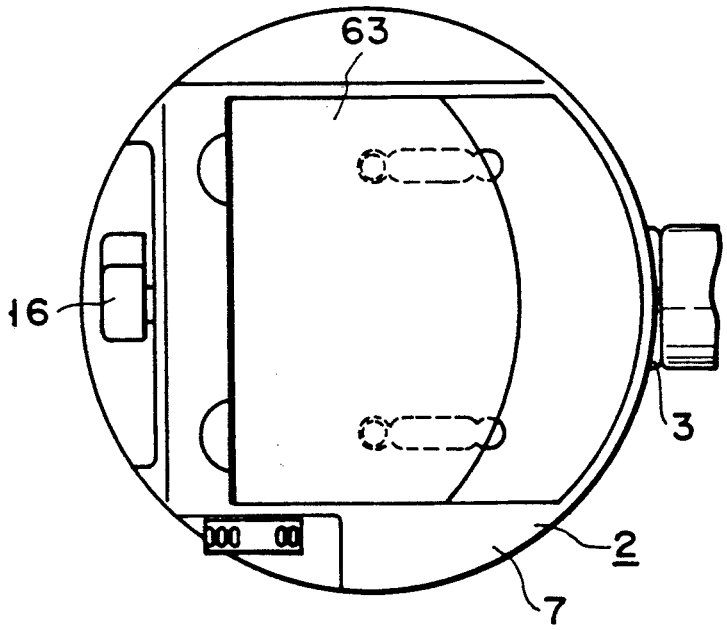
FIG. 15 shows a state in which suckers are housed in place.

In attaching nozzle 1 to inner wall surface 31 of the bathtub, according to this embodiment, cover 63 is slid open, as shown in FIG. 14, and lever 61 is turned to cause suckers 32*a* and 32*b* to project through opening 62, as shown in FIGS. 12 and 13. In this state, the suckers can be attached to wall surface 31. If surface 31 of the bathtub is a slant surface, suckers 32*a* and 32*b* are tilted corresponding to the tilt of surface 31 when they are fixed. In enjoying a massage with nozzle 1 in hand, lever 61 is turned to rock suckers 32*a* and 32*b* to the inside of nozzle case 7, as indicated by two-dot chain line in FIG. 12. If cover 63 is slid to close opening 62 in this state, as shown in FIG. 15, the suckers are housed in case 7. Accordingly, the suckers are not a hindrance to the nozzle operation. Thus, in the sixth embodiment, shaft 42 and the bearing portions of retaining arms 60*a* and 60*b* constitute rocking retaining means 38, while cover 63 and opening 62, along with retaining means 38, constitute holding means for suckers 32*a* and 32*b*.

Figure 16:
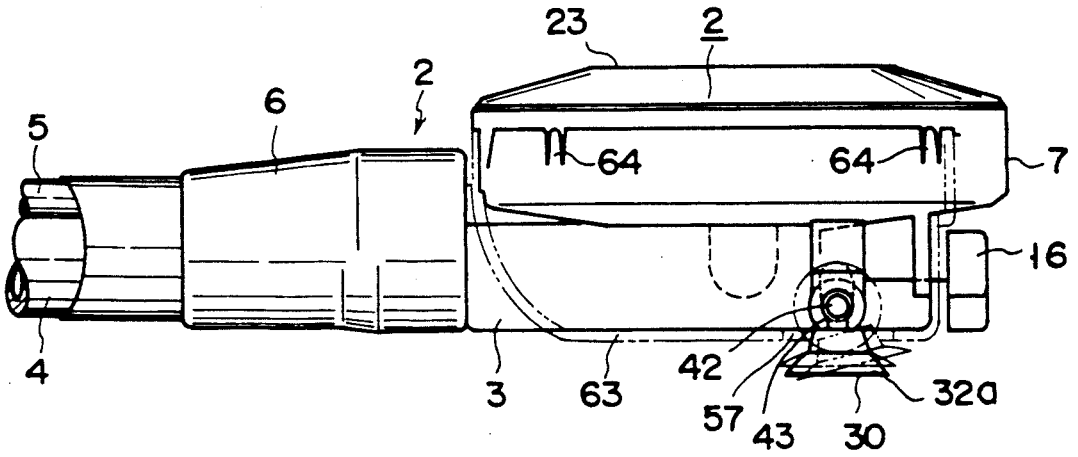
FIG. 16 is a side view of a nozzle according a seventh embodiment of the invention.
Figure 17:
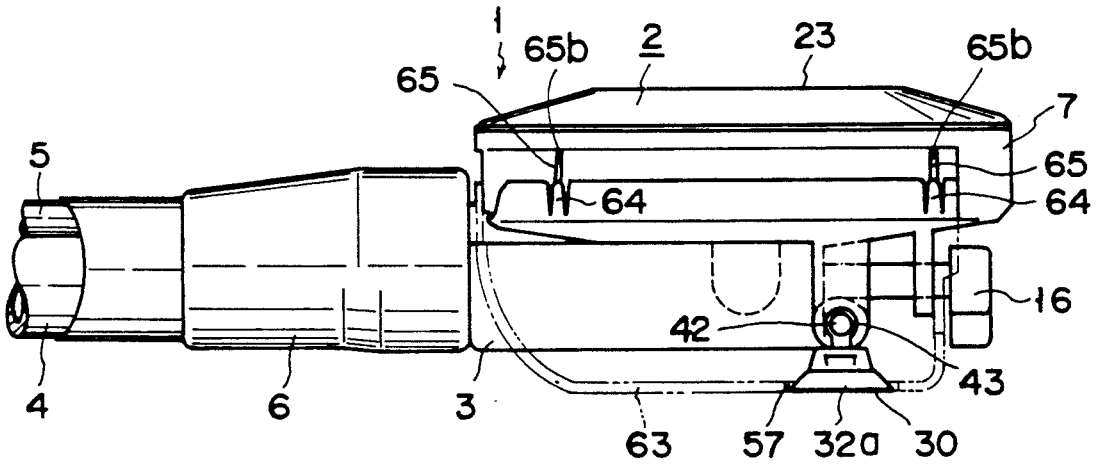
FIG. 17 is a side view showing a state in which suckers of the seventh embodiment are housed in place.
Figure 18:
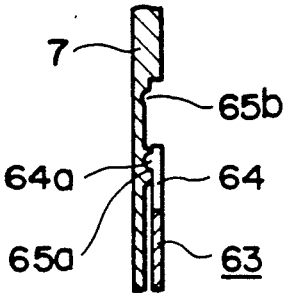
FIG. 18 shows the way a nozzle case and a cover of the seventh embodiment are engaged with each other.

FIGS. 16 to 18 show a seventh embodiment of the present invention.

This embodiment is arranged in the same manner as the sixth embodiment except for the configuration of cover 63. Cover 63 of the seventh embodiment is of a fit-on type such that it can be fitted onto nozzle case 7. Through hole 57 for the insertion of suckers 32*a* and 32*b* is bored through that portion of cover 63 which faces the suckers. A suitable number of elastic tongues 64 are formed on the peripheral wall of cover 63. Corresponding to tongues 64, slits 65 for the slide of the tongues are formed on the peripheral surface of case 7. As shown in FIG. 18, engaging recesses 65*a* and 65*b* adapted to engage engaging projection 64*a* on each corresponding tongue 64 are formed on the upper and lower end portions of each slit 65.

In suctionally fixing nozzle 1 to inner wall surface 31 of the bathtub, in this seventh embodiment, cover 63 is pressed against nozzle case 7 so that engaging projections 64*a* are fitted in their corresponding engaging recesses 65*b*. In this engaged state, as shown in FIG. 16, suckers 32*a* and 32*b* penetrate hole 57, thus projecting to the outside through the hole. In this state, therefore, the suckers can be attached to wall surface 31. In enjoying a massage with nozzle 1 in hand, cover 63 is dislocated so that engaging projections 64*a* are fitted in their corresponding engaging recesses 65*a*. In this engaged state, as shown in FIG. 17, the top surface of cover 63 is substantially flush with sucking surfaces 30 of suckers 32*a* and 32*b*, so that the suckers are housed inside cover 63. Thus, the bath massage can be effected with nozzle 1 in hand, without being hindered by the suckers.

Figure 19:
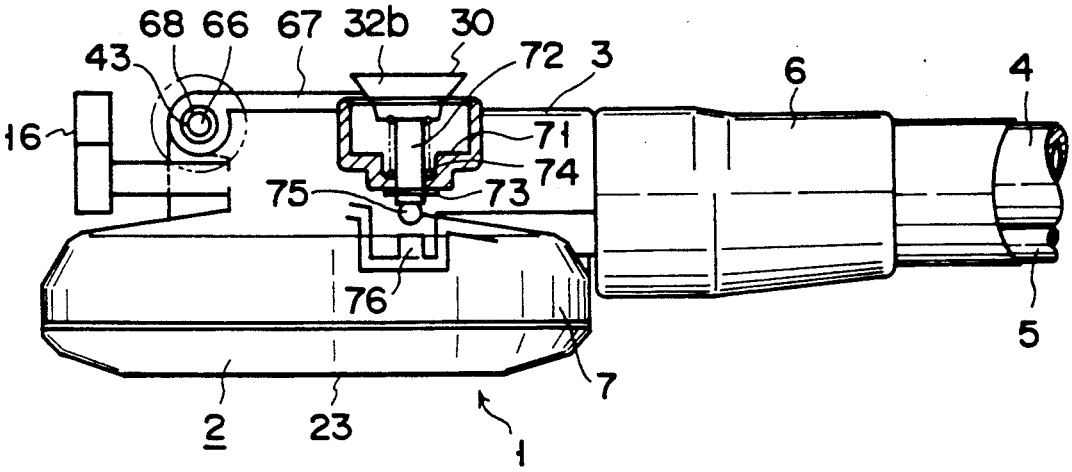
FIG. 19 is a side view of a nozzle according an eighth embodiment of the invention.
Figure 20:
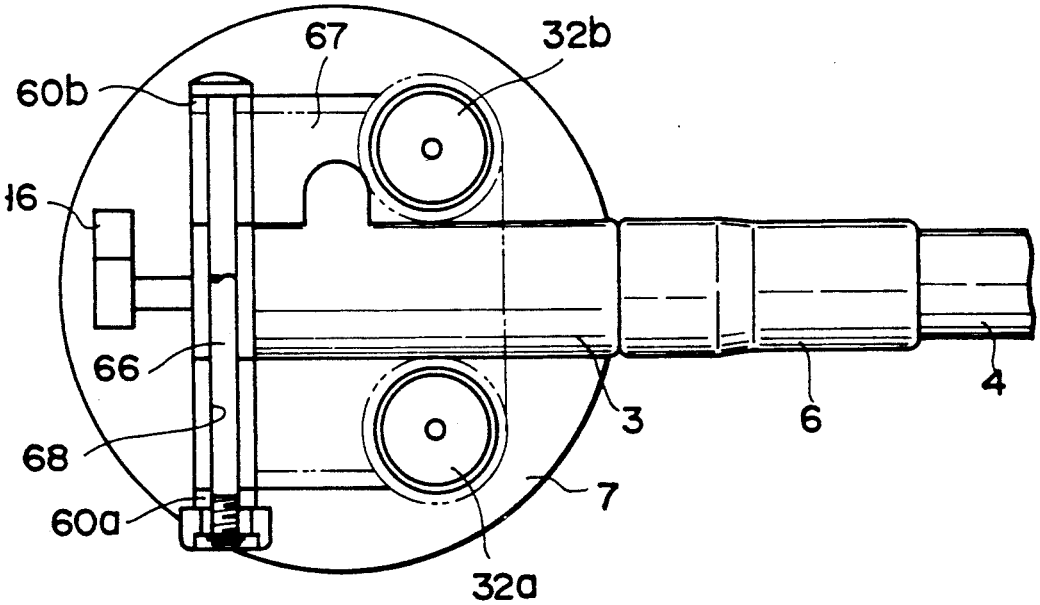
FIG. 20 is a plan view of the nozzle shown in FIG. 19.
Figure 21:
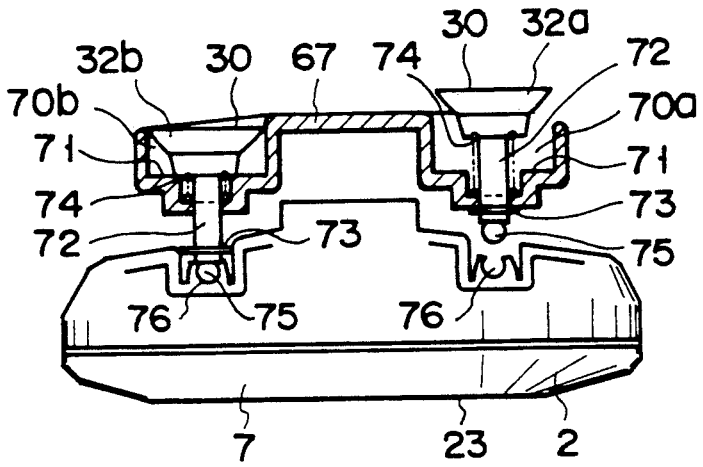
FIG. 21 is a front view of the nozzle shown in FIG. 19.
Figure 22:
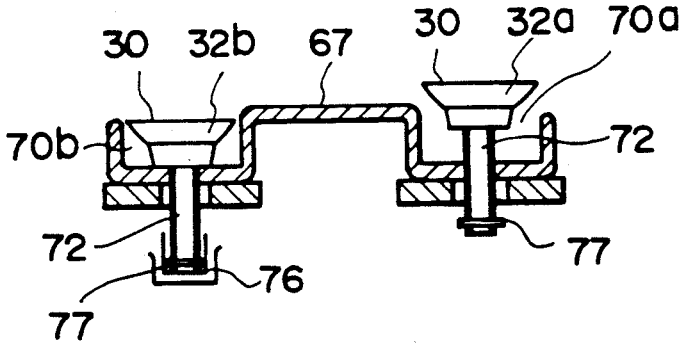
FIG. 22 shows another example of arrangement in which suckers are housed in place.

FIGS. 19 to 21 show an eighth embodiment of the present invention.

In this embodiment, retaining frames 60*a* and 60*b* protrude from the rear face of nozzle case 7, pin 66 is stretched between frames 60*a* and 60*b*, and the proximal portion of rocking plate 67 is rockably fitted on pin 66. Knurls 43 are formed on the surface of the shank portion of pin 66 and/or the inner peripheral surface of shaft hole 68 of rocking plate 67. Thus, the rocking position of plate 67 can be maintained by mean of frictional force produced by knurls 43, after rocking the plate around pin 66. In some cases, a screw may be fitted into a tapped hole in the wall of shaft hole 68 so that the tip end of the screw is pressed against pin 66, thereby maintaining the rocking position of rocking plate 67. Plate 67 is provided with holding recesses 70*a* and 70*b* for holding suckers 32*a* and 32*b* in positions symmetrical with respect to hot-water supply barrel 3. Sliding shaft 72 is slidably set in bottom wall 71 of each of recesses 70*a* and 70*b*, on the opening side thereof. Shaft 72 is prevented from slipping out of its corresponding recess by retaining member 73. Suckers 32*a* and 32*b* are fixed individually to the distal end portions of their corresponding sliding shafts 72 by means of screws or the like. Spring 74 in a compressed state is fitted on each shaft 72, between each sucker and bottom wall 71. Suckers 32*a* and 32*b* are pressed toward the opening side by the urging force of springs 74. Engaging ball 75 is formed on the other end of each sliding shaft 72. Engaging recesses 76 are formed in the rear face of nozzle case 7 which faces balls 75. They elastically engage and retain their corresponding balls 75.

In enjoying a jet massage with nozzle 1 of the eighth embodiment fixed to inner wall surface 31 of the bathtub, suckers 32*a* and 32*b* are projected from holding recesses 70*a* and 70*b*, respectively, by taking out engaging balls 75 from their corresponding engaging recesses 76, as shown in FIG. 19. In this state, suckers 32*a* and 32*b* may be attached to wall surface 31 for the bath massage. If surface 31 is a slant surface, rocking plate 67 is rocked around pin 66 so that sucking surfaces 30 of the suckers are tilted corresponding to the tilt of slant surface 31. By doing this, the jet can be ejected horizontally with nozzle 1 on wall surface 31. In enjoying a massage with nozzle 1 in hand, on the other hand, suckers 32*a* and 32*b* are forced into holding recesses 70*a* and 70*b*, respectively, against the urging force of springs 74. At this time, engaging balls 75 are engagedly held in their corresponding engaging recesses 76, so that the massage can be effected with nozzle 1 in hand, without being hindered by the suckers.

In this eighth embodiment, each engaging recess 76 may be formed of a high-friction member, such as rubber, which has a circular inner peripheral surface. In this case, piston portion 77, which is also formed of a high-friction member, such as rubber, may be provided on each sliding shaft 72. Thus, suckers 32*a* and 32*b* can be kept housed in holding recesses 70*a* and 70*b*, respectively, by the force of friction between piston portions 77 and their corresponding engaging recesses 76.

Figure 23:
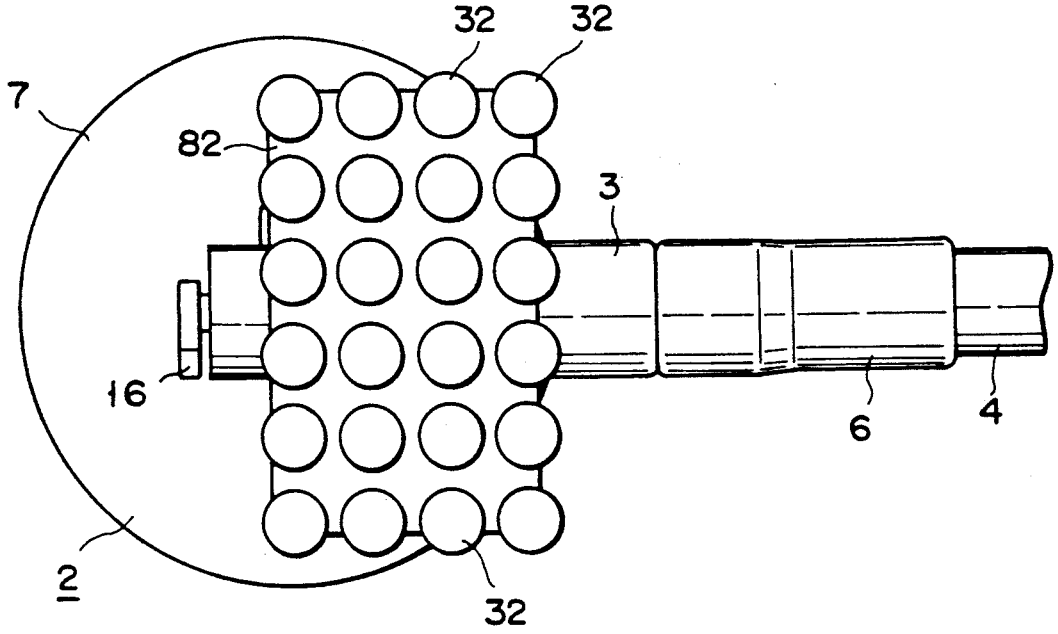
FIG. 23 is a bottom view of a nozzle according a ninth embodiment of the invention.
Figure 24:
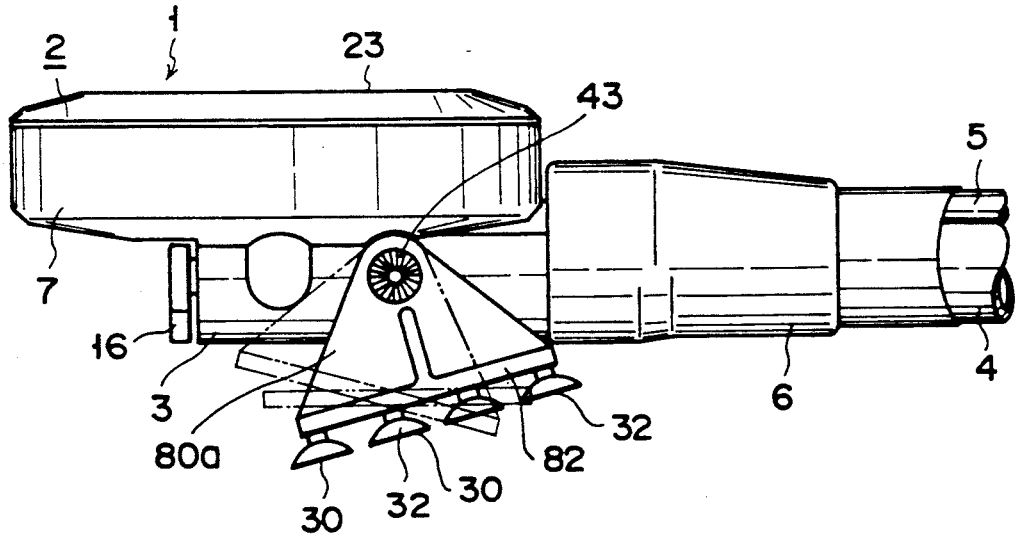
FIG. 24 is a side view of the nozzle shown in FIG. 23.
Figure 25:
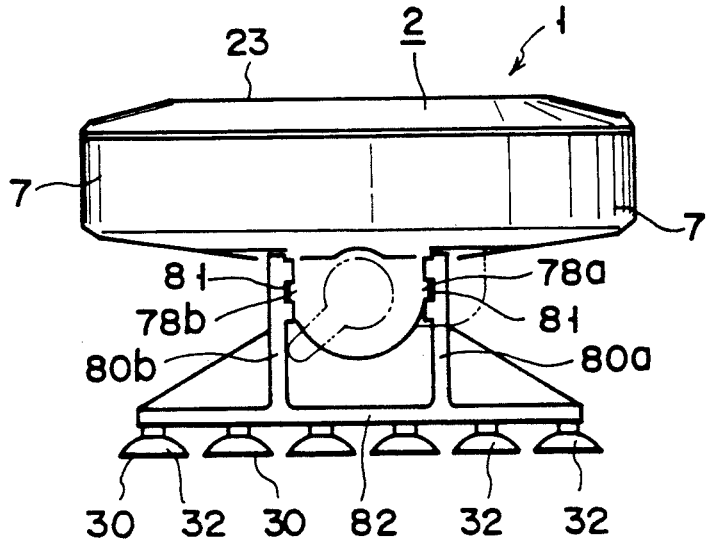
FIG. 25 is a left side view of the nozzle shown in FIG. 24.

FIGS. 23 to 25 show a ninth embodiment of the present invention.

In this embodiment, pivot portions 78*a* and 78*b*, which protrude individually from two opposite side faces of hot-water supply barrel 3, are rockably fitted in their corresponding pivot holes 81 formed in retaining plates 80*a* and 80*b*. Also in this ninth embodiment, knurls 43 are formed on the surfaces of pivot portions 78*a* and 78*b* and/or the respective inner peripheral surfaces of pivot holes 81, so that the rocking positions of plates 80*a* and 80*b* can be maintained with stability. Sucker fixing base 82 is connected to the respective end edges of retaining plates 80*a* and 80*b*. A plurality of suckers 32 are fixed to the surface of base 82 by means of screws or the like.

In the ninth embodiment, retaining plates 80*a* and 80*b* can be stably held in their respective rocking positions by being rocked around pivot portions 78*a* and 78*b*, respectively. Thus, even if inner wall surface 31 of the bathtub, to which suckers 32 are fixed, is a slant surface, the jet can be ejected horizontally into the bathtub. Since suckers 32 arranged on sucker fixing base 82 are small-sized, moreover, they can be easily removed from wall surface 31.

Figure 26:
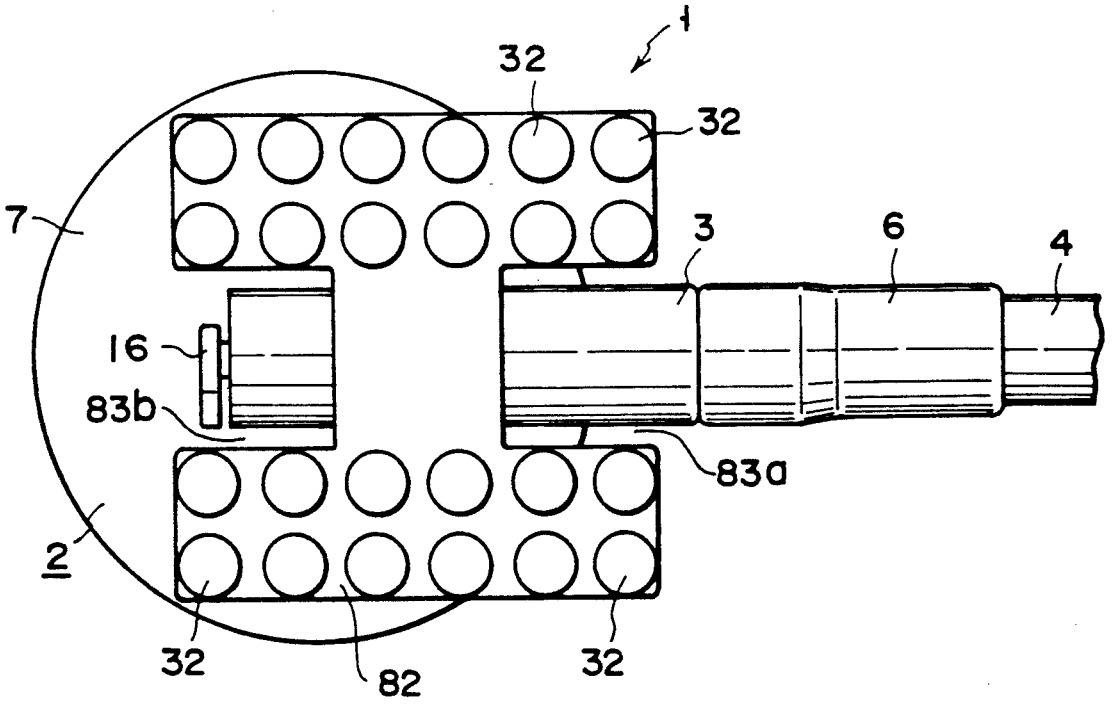
FIG. 26 is a bottom view of a nozzle according a tenth embodiment of the invention.

FIG. 26 shows a tenth embodiment of the present invention.

This embodiment differs from the ninth embodiment only in that recesses 83*a* and 83*b* are formed individually at two opposite sides of sucker fixing base 82 which faces hot-water supply barrel 3. According to the ninth embodiment, base 82 is not provided with recesses 83*a* and 83*b*. When it rocks around pivot portions 78*a* and 78*b*, therefore, its end portion abuts against barrel 3. Thus, the range of rocking motion of base 82, that is, the tilt of suckers 32, is restricted. In the tenth embodiment, however, recesses 83*a* and 83*b* function as escape portions which allow sucker fixing base 82 to avoid engaging hot-water supply barrel 3. Accordingly, the range of rocking motion of base 82 or the tilt of suckers 32 can be increased.

Figure 27:
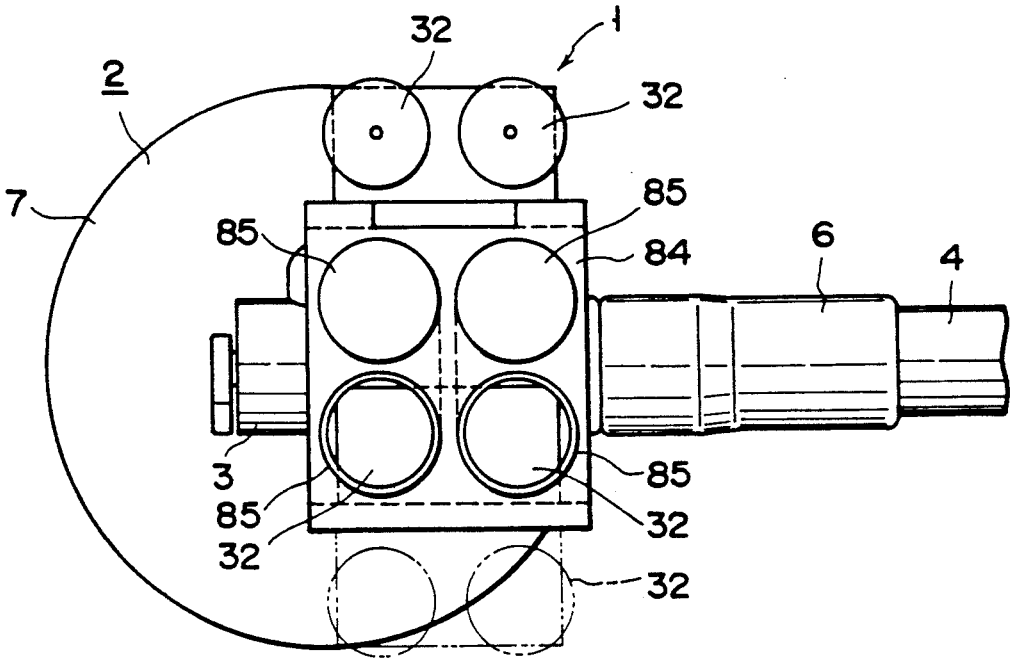
FIG. 27 is a bottom view of a nozzle according an eleventh embodiment of the invention.
Figure 28:
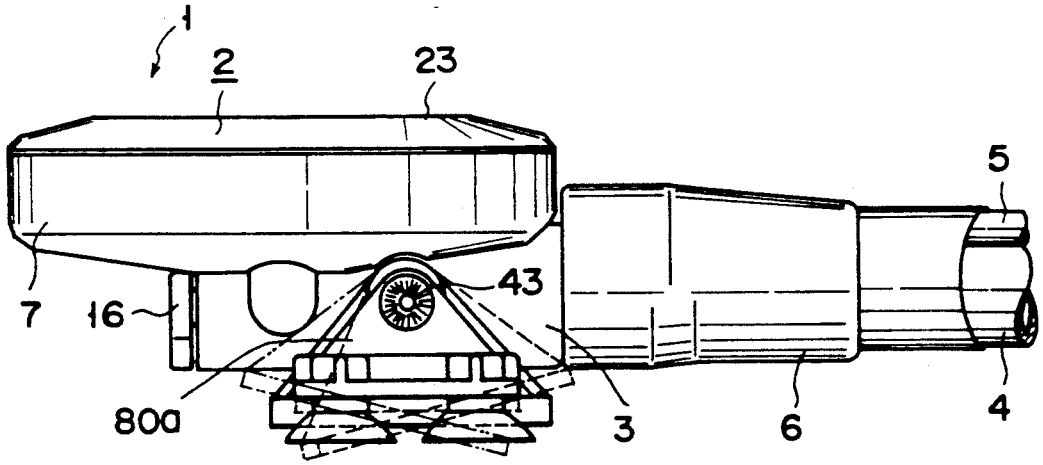
FIG. 28 is a side view of the nozzle shown in FIG. 27.
Figure 29:
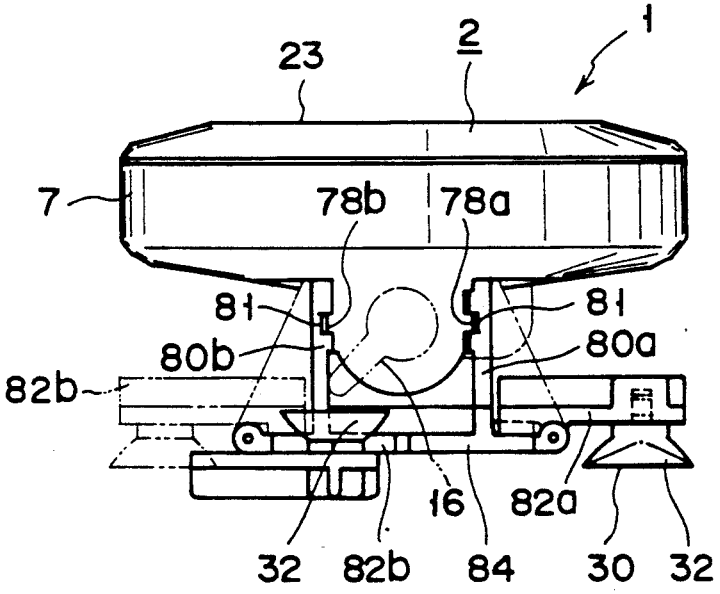
FIG. 29 is a left side view of the nozzle of FIG. 28.

FIGS. 27 to 29 show an eleventh embodiment of the present invention.

In this embodiment, just as in the ninth and tenth embodiments, retaining plates 80*a* and 80*b* are rocked around pivot portions 78*a* and 78*b*, resisting frictional force produced by knurls 43. The eleventh embodiment differs from the ninth and tenth embodiments in that independent sucker fixing bases 82*a* and 82*b* are attached to retaining plates 80*a* and 80*b*, respectively. In this arrangement, sucking surfaces 30 of suckers 32 attached to base 82*a* and those of suckers 32 attached to base 82*b* can be turned in different directions, so that nozzle 1 can be attached to, for example, two adjacent inner wall surfaces at a corner portion of the bathtub. In enjoying a massage with nozzle 1 in hand, therefore, sucker fixing bases 82*a* and 82*b* are rotated around pivot portions 78*a* and 78*b* to positions where sucking surfaces 30 of suckers 32 are opposed to the rear face of nozzle case 7, as shown in FIG. 29 (for base 82*b*). By doing this, bases 82*a* and 82*b* are folded up, and suckers 32 are fittingly housed in sucker receiving holes 85 in connecting plate 84. Holding nozzle 1 in hand in this state, a user can enjoy a massage without being hindered by suckers 32.

It is to be understood that the present invention is not limited to the embodiments described above, and that various changes and modifications may be effected therein by one skilled in the art without departing from the scope or spirit of the invention.

What is claimed is:

1. A nozzle comprising:

a nozzle body having means for mixing hot water with air in a chamber having a jet hole for discharging the hot water mixed with air;

sucker means directly attached to a rear face portion of the nozzle body and adapted to fix the nozzle body to the surface of an inner wall of a bathtub by suction;

angle adjusting means, provided between the nozzle body and the sucker means, for adjusting the angle of the nozzle body relative to said sucker means and to a surface level of hot water in the bathtub; and housing means for housing the sucker means, said housing means including means for moving the sucker means into and out of said housing means.

2. A nozzle construction comprising:

a nozzle body having first and second chambers, said first chamber communicating with a plurality of holes in said nozzle body for discharging liquid therefrom, and said second chamber communicating with a jet hole in said nozzle body for discharging liquid mixed with air, said nozzle body in communication with a liquid supply conduit and an air supply duct for supplying liquid and air, respectively, to said nozzle body, valve means for directing liquid from said liquid supply conduit selectively into one or the other of said first and second chambers, said air duct being in direct communication with said second chamber;

hand operated lever means connected to said valve means for directing flow of said liquid to one or the other of said first and second chambers, such that when said liquid is directed to said second chamber, said liquid is caused to mix with air in said second chamber so that a mixture of liquid and air is discharged from said jet hole;

sucker means attached to said nozzle body and adapted to secure the nozzle body to an inner wall of a bathtub by suction; and angle adjusting means for moving said nozzle body relative to said sucker means to thereby adjust said nozzle body relative to a plane defined by a level of liquid in the bathtub.

3. The nozzle according to claim 2, further comprising means for housing said sucker means.

4. The nozzle according to claim 3, wherein said housing means includes a cover for concealing the rear face portion of the nozzle body.

5. The nozzle according to claim 3, wherein said housing means includes means for moving the sucker means into and out of said housing means.

* * * * *